United States Patent [19]

Baur et al.

[11] Patent Number: 4,531,798

[45] Date of Patent: Jul. 30, 1985

[54] HEAVY-DUTY ELECTRICAL CONNECTOR

[75] Inventors: Robert Baur, Los Angeles; Ralph T. Iversen, Granada Hills; Roger C. Stephenson, Woodland Hills, all of Calif.

[73] Assignee: Automation Industries, Inc., Greenwich, Conn.

[21] Appl. No.: 363,253

[22] Filed: Mar. 29, 1982

[51] Int. Cl.[3] ..... H01R 13/54

[52] U.S. Cl. ..... 339/75 M; 339/94 M; 339/113 L

[58] Field of Search ..... 339/91 R, 75 M, 147 R, 339/89 R, 90 R, 94 M, 113 R, 113 L, DIG. 2

[56] References Cited

U.S. PATENT DOCUMENTS

| | | | |
|---|---|---|---|
| 3,721,943 | 3/1973 | Curr | 339/94 M |
| 3,754,206 | 8/1973 | Obeissart | 339/90 R |
| 4,183,605 | 1/1980 | Arneson | 339/89 M |

*Primary Examiner*—Z. R. Bilinsky

*Attorney, Agent, or Firm*—Thomas L. Flattery

[57] ABSTRACT

To prevent possible misalignment of the various parts of a plug and receptacle connector, if the coupling ring is inadvertently rotated before the receptacle is in full position, there is provided an interlock sleeve. This sleeve is spring-loaded and positioned between the coupling ring and the plug outer surface. Internal and external keys incorporated within the sleeve prevent inadvertent rotation of the coupling ring until the receptacle has made entry into the plug sufficiently to key both the coupling ring and plug shell.

7 Claims, 22 Drawing Figures

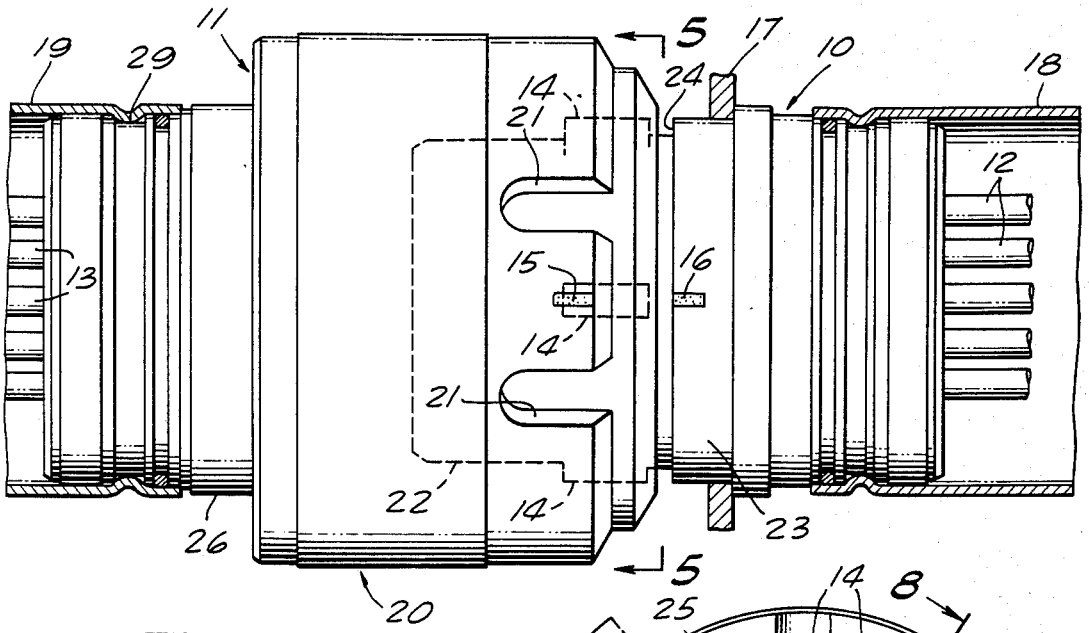
FIG. 4.
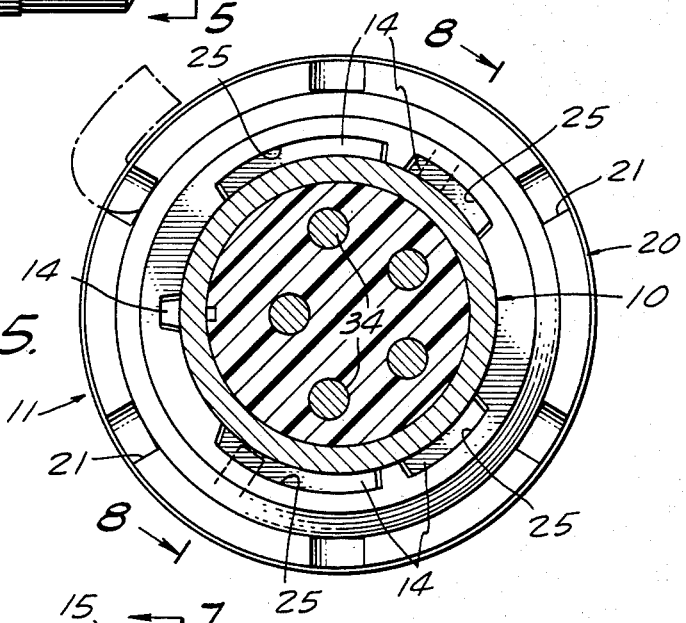
FIG. 5.
FIG. 6.
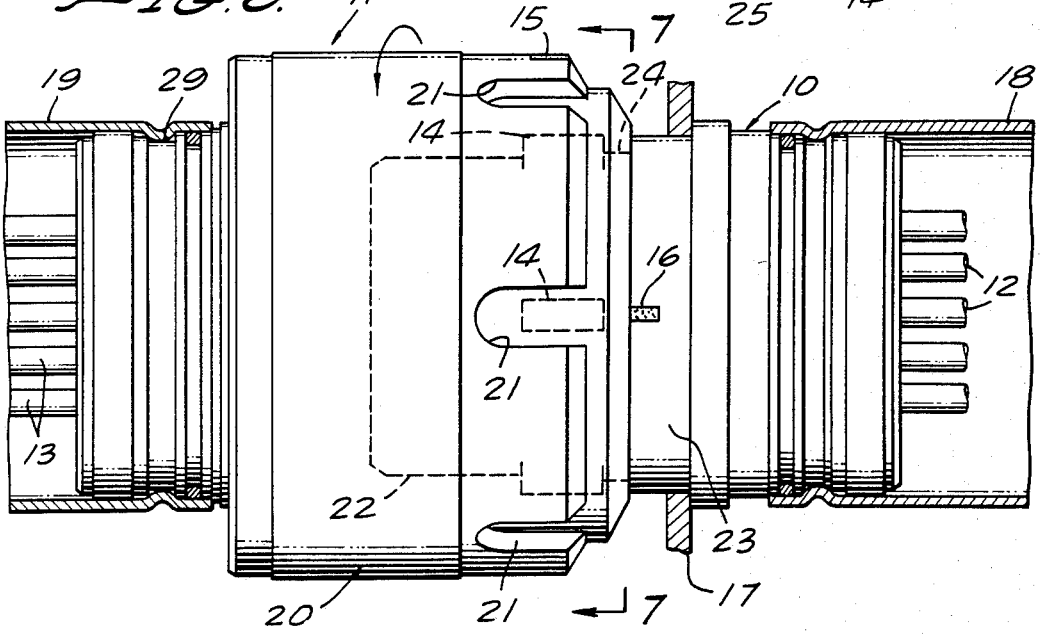

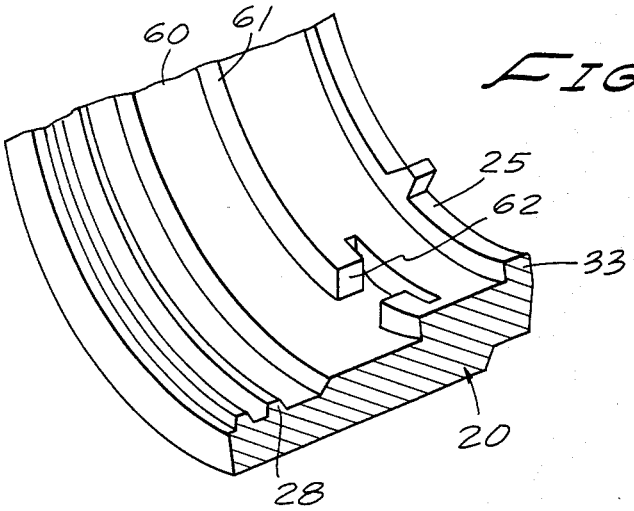
FIG. 20.
FIG. 21.
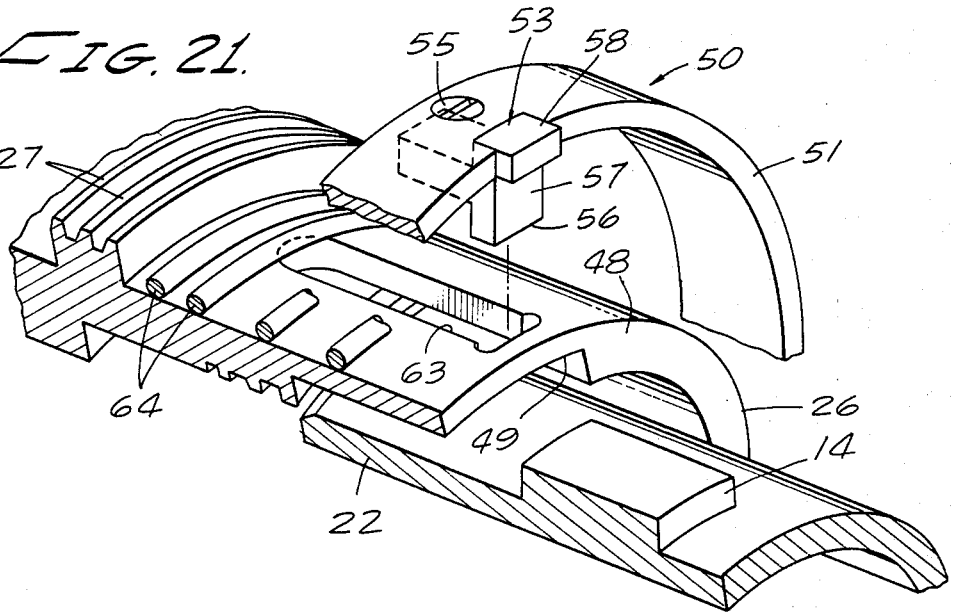
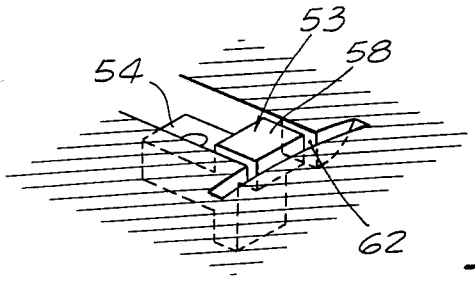
FIG. 22.

HEAVY-DUTY ELECTRICAL CONNECTOR

The present invention relates generally to an electrical connector and, more particularly, to an improved quick-connect, quick-disconnect electrical connector for use in relatively high-voltage and current carrying applications.

BACKGROUND OF THE INVENTION

In electrical power applications, particularly those relating to aerospace and military, there is a need for a heavy-duty electrical connector having a combination of qualities which are not provided by known existing connectors. For example, a fully satisfactory connector of this kind would possess high resistance to electromagnetic interference, quick mating and unmating of parts, means for sealing the cable against the ingress of moisture, dirt, dust, or the like and audible/tactile/-visual mating and unmating indication means.

Moreover, many techniques commonly utilized in relatively small-size electronic releasable connectors are not suitable for larger and heavier electrical power connectors. A heavy duty connector will, of necessity, terminate at a large cable which because of its relatively large conductors (e.g., 16 gauge to 4/0 gauge) and external shielding or metal sheath, is extremely rigid as compared to, say, a cable containing 22 gauge to 20 gauge conductors.

In U.S. Pat. No. 4,066,315 there is described an electrical cable connector with keyed parts which are lockingly intermated by rotation of a coupling housing, the latter including a separate internal nut that drives the connector parts. This connector is widely accepted at this time as an excellent means for releasably interconnecting electronic equipment. Frequently the relative orientation of the keys and keyways is not precise making it necessary to rotate or twist the cable to align the connector parts. In using this type of connector on a heavy duty application, the torgue required to twist a cable of large conductors and connector part secured thereto, can result in misalignment of the coupling housing and internal nut which would prevent mating of the connector parts.

The patented electrical connector compensates for accumulated tolerances of its different components by incorporation of various spring-type devices between the coupling housing and the other parts. However, these devices are sensitive to and adversely affected by forces applied to the cable tending to pull the connector apart. That is, cable loads sufficient to deflect the spring devices will effect separation of the connector parts at the interface producing undesirable contact movement and reduction or even total loss of compression at the interface seal.

Still further, a fully satisfactory electrical connector of this category must be able to withstand a variety of hostile environments, such as seismic and pyrotechnic shock, humidity, temperature extremes, icing, sand and dust.

SUMMARY OF THE INVENTION

The connector described herein includes plug and receptacle parts which can be quickly and releasably mated to each other for interconnecting cable wires via respectively carried socket and pin contacts. The plug includes an outer, hollow cylindrical coupling ring which on rotation has internal threads that cooperate with threads on the plug to drive the plug and receptacle toward or away from one another, depending upon the direction of ring rotation. Detent springs mounted on one connector part are arranged relative to corresponding detent cavities such that when the connector parts are located at the fully-mated and fully-unmated positions, these springs will snap into the cavities providing both audible and tactile indications. The detent spring also functions as a means for preventing accidental backing off of the parts from their fully-mated position when subjected to shock or vibration, thereby preventing accidental interruption of the circuits controlled by the connector. Visual indicating of the relationship of the connector parts is provided by peripherally provided indicia on the connector parts.

The pins typically found on the plug part are of three different lengths, the longest functioning as a ground pin for establishing a fully grounded condition of both connector parts before any power connections are made. The power line contacts engage second, and finally the last set of contacts energize an external relay which applies the operational voltages to the line contacts.

A rubber interface seal has raised sealing cones around each pin contact which seat in the corresponding conical cavities in the socket insert face. This seal, in addition to keeping moisture, dirt and dust from the connector electrodes during mating, serves also to function as a tolerance compensation device and which is totally insensitive to separation resulting from application of external, axially directed forces to the connector parts.

A multiple spring-finger assembly is bonded into the plug shell and cooperatively engages the receptacle leading nose end to provide multiple grounding points during mating of the plug and receptacle. In this way, protection against environmental electromagnetic interference is gained.

The coupling ring is threadedly received on the plug and there are tandem keyways on both which serve to insure aligned receipt of the receptacle therewith. On mating, the receptacle keys engage the tandem aligned keyways of both the coupling ring and the plug shell. The receptacle keys on passing beyond the coupling ring keyways, are now engaged only with the plug shell keyways such that the coupling ring is now free to be manually rotated to its full mating position. During unmating, the sequence is reversed.

To prevent possible misalignment of the various parts if the coupling ring is inadvertently rotated before the receptacle is in full position, there is provided an interlock sleeve. This sleeve is spring-loaded and positioned between the coupling ring and the plug outer surface. Internal and external keys incorporated within the sleeve prevent inadvertent rotation of the coupling ring until the receptacle has made entry into the plug sufficiently to key both the coupling ring and plug shell.

DESCRIPTION OF THE DRAWING

FIG. 4 shows the plug and receptacle of FIG. 1 properly aligned and in an initial stage for mating.

FIG. 5 is a sectional, end elevational view taken along the line 5—5 of FIG. 4.

FIG. 6 is similar to FIG. 4 showing the plug and receptacle mated.

FIG. 20 is a perspective view of part of the coupling ring interior.

FIG. 21 is an exploded view of plug shell, receptacle and interlock sleeve.

FIG. 22 is a perspective view showing interlock of the coupling ring.

DESCRIPTION OF A PREFERRED EMBODIMENT

Figure 1:
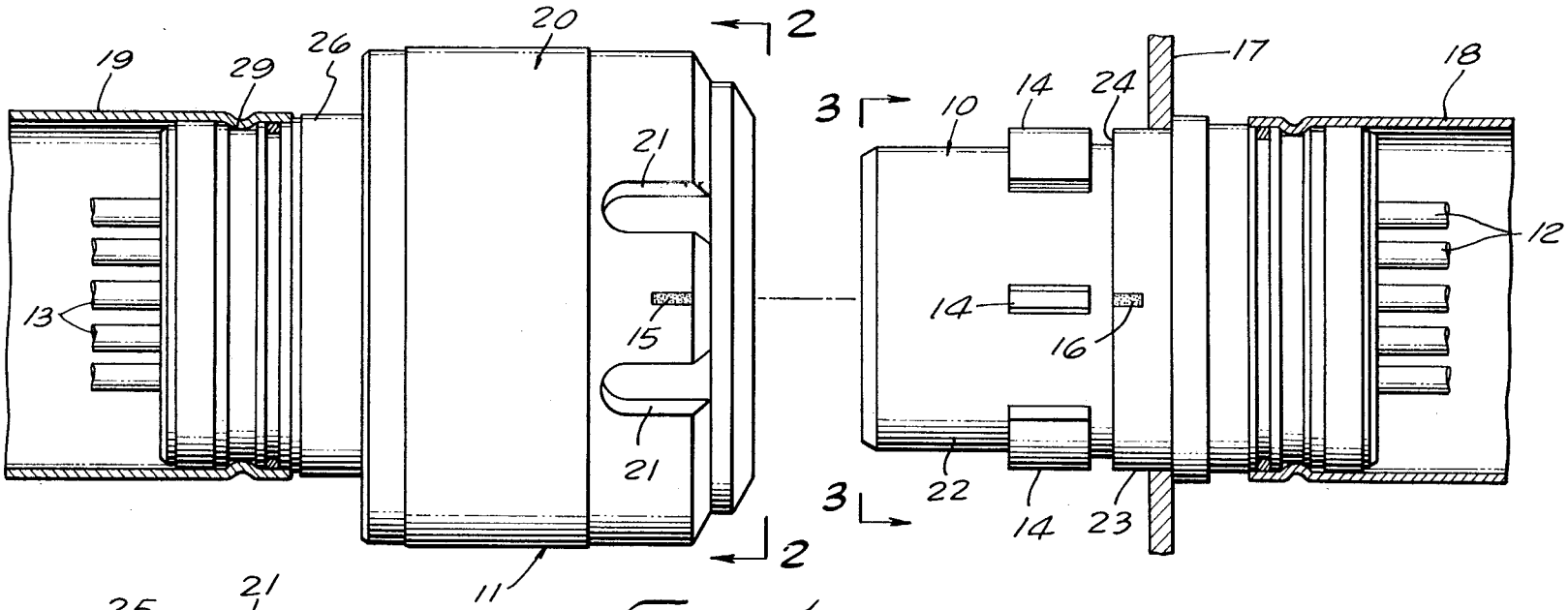
FIG. 1 is a side elevational view of a plug and receptacle of the present invention shown separated.
Figure 3:
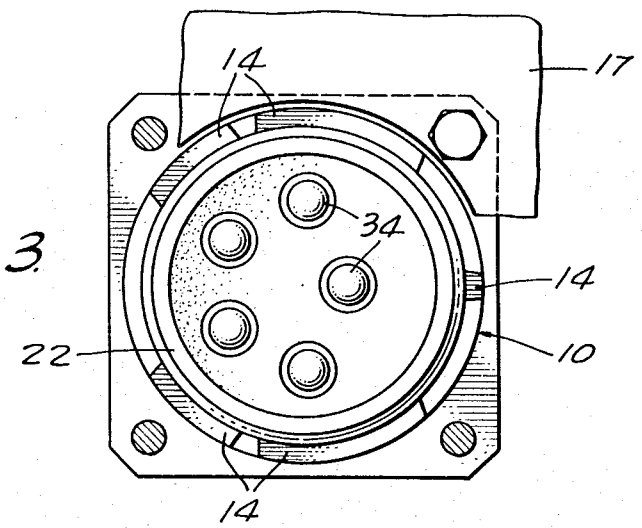
FIG. 3 is an elevational view looking into the open receptacle and taken along the line 3—3 of FIG. 1.

Turning now to the drawing and particularly FIG. 1, an electrical connector with which the present invention is particularly concerned is seen to include in its major parts a receptacle 10 and a plug 11 which are intermateable in a way to be described for releasably interconnecting the respective wires of cables 12 and 13. A set of keys 14 are arranged about the circumference of the leading end of the receptacle 10 and slidingly received within complementary keyways in the plug 11 when the connector parts are properly aligned. The parts alignment is visually assured to the user of the connector when a corresponding alignment of colored stripes 15 and 16 is achieved.

The connector being described here is especially contemplated for handling relatively high power and interconnecting cable wires 12 and 13 in the range of 16 gauge to 4/0 gauge.

A set of pin contacts are conventionally provided within the receptacle 10 when which properly received within a set of socket contacts in the plug serve as the interconnection means for the cables 12 and 13. It is also a frequent expedient for the receptacle 10 to be fixedly mounted to a wall 17.

The cables 12 and 13 are each enclosed within a tubular metal shield 18 and 19, respectively, the ends of which are crimped onto the plug and receptacle (e.g., by magneforming). Alternatively, the shields may be joined threaded by a threaded joint. As will be described later herein, when the connector parts 10 and 11 are intermated, the pin and socket contacts are effectively shielded against electromagnetic environments also, as well as sealed against contamination by moisture, dust, dirt or other foreign matter.

A coupling ring or housing 20 which is an integral part of the plug includes a plurality of slots 21 formed on its circumferential periphery via which the housing may be rotated about its axis by the use of a spanner wrench, for example, in coupling and uncoupling the connector parts to each other.

Figure 2:
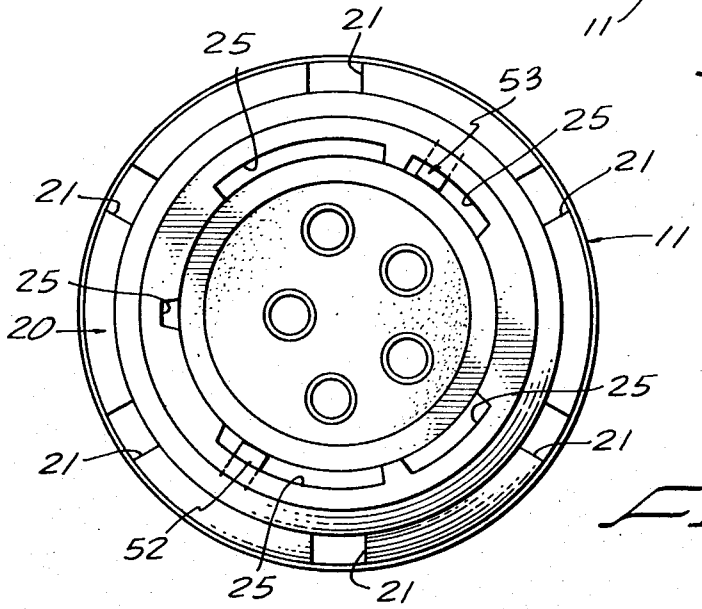
FIG. 2 is an end elevational view taken along the line 2—2 of FIG. 1 looking into the open plug end.
Figure 7:
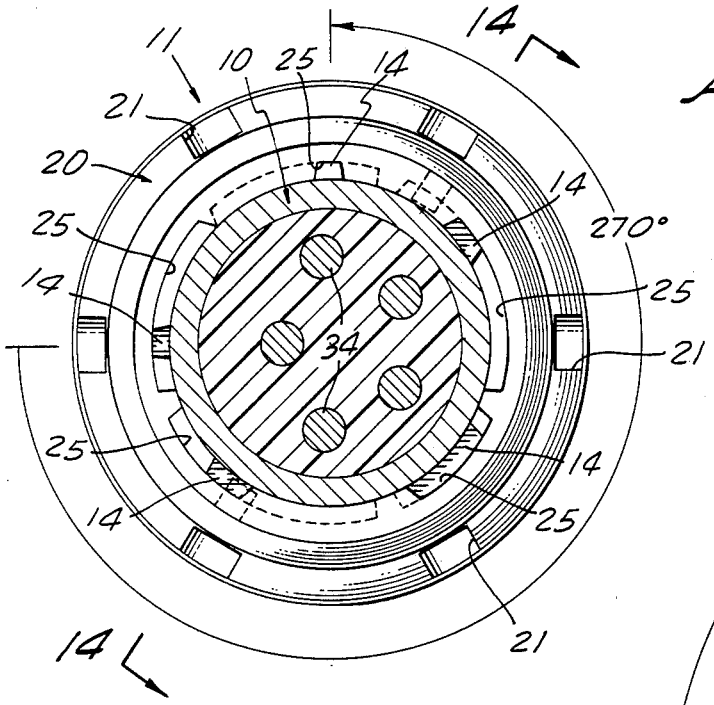
FIG. 7 is a sectional, end elevational view taken along the line 7—7 of FIG. 6.

For the ensuing general description of the general mechanical operation involved in interconnecting or intermating the plug and receptacle connector parts, reference is made to FIGS. 1, 4 and 6. As can be seen best in FIG. 1, the outer end of the receptacle includes a cylindrical portion 22 of uniform diameter that extends inwardly to an enlarged mounting flange 23. The keys 14 are arranged about the cylindrical portion 22 at a predetermined uniform spacing 24 from the flange 23. The keys 14 are seen to be of varying width which corresponds to keyways 25 (FIG. 2) formed in the inner wall of the coupling ring and to other identical keyways in the plug interior thereby insuring that the receptacle can only be received within the plug end when a predetermined orientation is achieved interconnecting the correct pins and sockets to each other.

To mate the plug and receptacle, the parts are first aligned, using the colored stripes 15 and 16 as visual guides for this purpose. Then, the receptacle can be axially moved into the plug open end with the keys 14 fitting into corresponding keyways 25. This axial movement is continued until the coupling ring outer end is located in the space 24 as in FIG. 6. The coupling ring 20 that is received over the other plug parts can now be rotated which, in a way that will be described, by means of an internal thread moves the internal plug parts still farther toward the receptacle until full mating relation is achieved (FIG. 6). At the conclusion of mating of the parts, a distinct clicking or snapping is both heard and felt, the manner and means for accomplishing this being described later.

Figure 8:
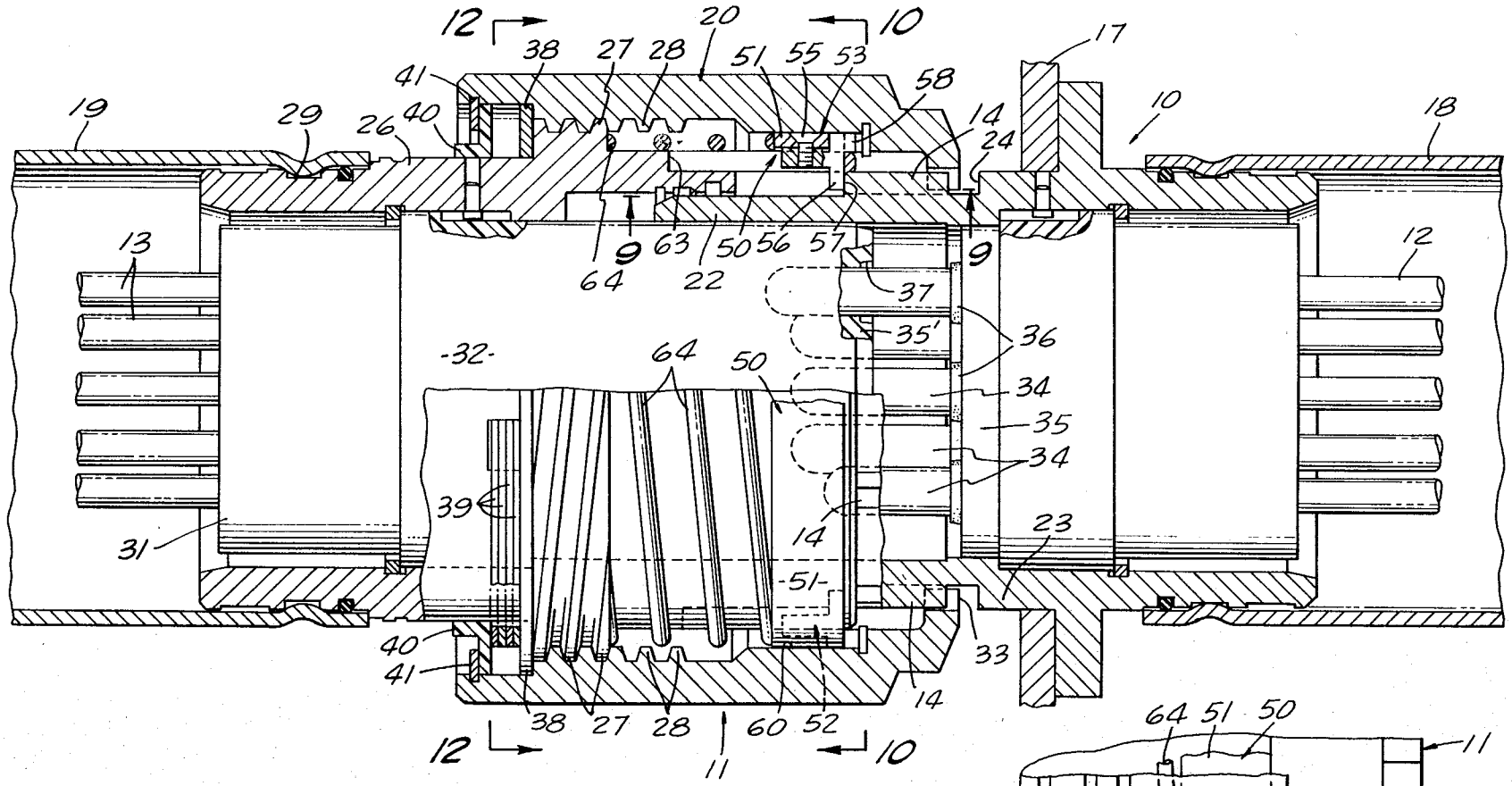
FIG. 8 is a side elevational, sectional view taken along the line 8—8 of FIG. 5.

The plug 11 includes a hollow cylindrical shell 26 having a set of threads 27 on its external periphery for cooperating with an internal set of threads 28 on the coupling ring (FIG. 8). The plug shell also includes on its outer surface adjacent the cable entry at least one continuous circumferentially extending groove 29 into which facing portions of the cable shield 19 are crimped. Socket contacts (not shown) are located in a hard, rigid insulator fittingly received within the plug shell. The cable wires 13 extend through suitable passages in the grommet 31 and insert 32 for connection with the respective socket contacts by crimping, for example. The grommet 31 is constructed of a soft and resilient rubber, for example, and is bonded to the insulative insert 32.

The coupling ring 20 is generally cylindrical including at its forward end a radially inwardly directed rim 33 having the keyways 25 formed therein in accordance with the pattern and arrangement of receptacle keys 14. When the plug and receptacle are joined with the keyways moving through and past the keyways, the solid part of rim 33 is located within the space 24 and on rotation of the coupling housing the rim is held between the keys and shoulder 23. At the beginning of coupling housing rotation, the pin contacts are already partially received within the sockets so that further rotation draws the pins further into the sockets.

Known prior coupling mechanisms, such as that disclosed in the reference U.S. patent, consist of a two-part construction, namely, an outer shell and a separate inner nut which is threaded onto the plug shell. The coupling nut was spring-loaded, as by a wavy washer for example, to serve as a tolerance compensating means. Not only was there the problem of compensating for accumulated tolerances of metal parts, but in many cases the insert for sockets in electronic connectors were all made of hard rubber or plastic which increased the tolerance problem. The spring-loaded nut was found sufficiently resilient to readjust itself for tolerance differentials existing in the various parts while maintaining good electrical contact between the pins and sockets even when subjected to vibration and shock. However, this two-piece coupling ring was relatively complex and costly to manufacture as well as resulting in a relatively heavy connector.

The coupling ring 20 described here is of one-piece construction which is simpler and less expensive to manufacture, and is lighter in weight, than the known prior two-piece construction. The pin contacts 34 are passed through an insert in the receptacle over the outer face of which is received a compliant insulative layer or interface seal 35 which abuts against the outer surface of insulative insert 32 during mating.

Figure 19:
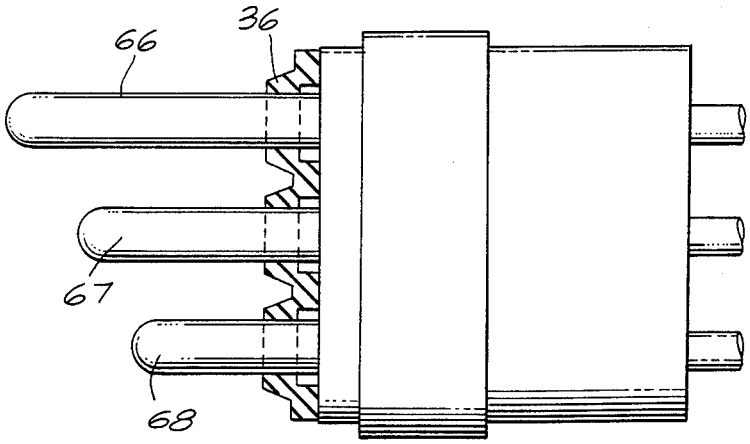
FIG. 19 is a side elevational view of the pins extending from the pin insert.

With reference now to both FIGS. 8 and 19, a raised ridge or cone 36 of the compliant material 35 is provided for fitting receipt within a similarly dimensioned cuplike groove or cavity 37 surrounding each socket access opening in insulative insert 32. By this means, an effective seal against the undesirable ingress of moisture, dirt and dust to the pin and socket contact is provided when the connector parts are mated. Also, the compliance of the interface seal 35 serves as a tolerance compensation means.

Still referring to FIG. 8, the opposite or trailing end of the coupling ring 20 has a relatively smooth, uniform internal diameter portion extending from the end inwardly a short distance to the beginning of the threads 28. A washer 38 abuts against an inner corner formed in the coupling housing wall and against which a number of identically shaped detent springs 39 are disposed. A ferrule 40 with extended rim is fittingly received within the coupling ring and slidingly received over the outer plug shell end. The ferrule is held against the outermost detent spring 39 by a retaining ring 41.

Figure 12:
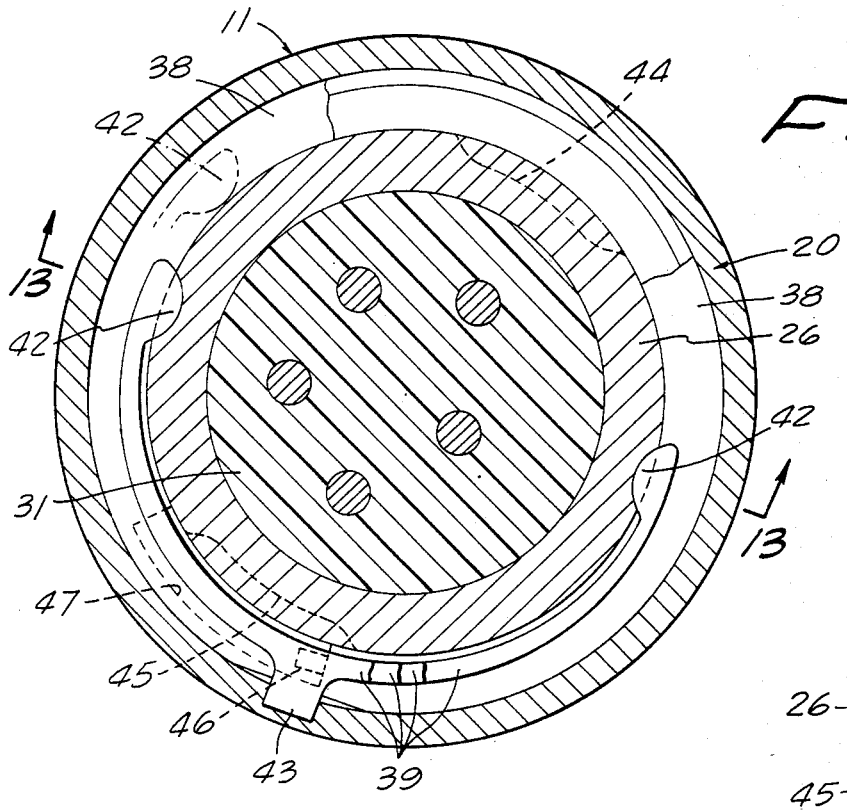
FIGS. 12 and 13 are sectional views taken along the lines 12—12 of FIG. 8 and 13—13 of FIG. 12, respectively.

Turning to FIG. 12, each detent spring 39 is seen to consist of an elongated springlike member having the general shape of a semicircle. The ends have a slightly enlarged radially inwardly directed, convexly curved head 42. At substantially the mid-point of the spring is a radially outwardly extending rectangular tab 43 which fits into an accommodating groove in the coupling ring inner wall. The spring detents are so dimensioned as to resiliently urge the curved heads 42 against the outer surface of the plug shell. A pair of recessed surface areas 44 and 45 are formed on the plug shell 26 outer surface at 180 degrees from each other and are so located that when the connector parts are fully mated the rounded ends of the detent springs snap into the recessed surface areas. It is this action that gives both a tactile and audible indication of connector mating. Also, when the curved heads are on the recessed areas 44 and 45, the detent spring action holds the mated connector parts together, preventing inadvertent disengagement.

A second pair of recessed surface areas (not shown) similar to the first described areas 44 and 45 are formed on the plug outer shell at points corresponding to the unmated position of the plug and receptacle. That is, on the coupling ring being rotated from the mated position it will upon reaching the unmated or released position provide an audible and tactile indication.

Figure 13:
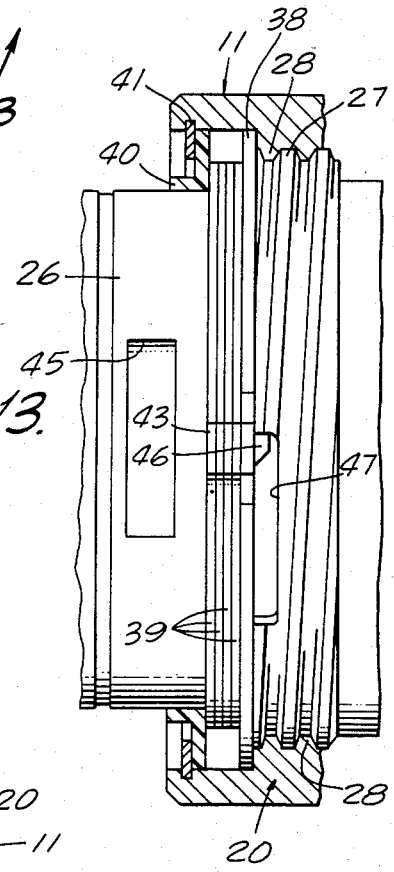
Figure 16:
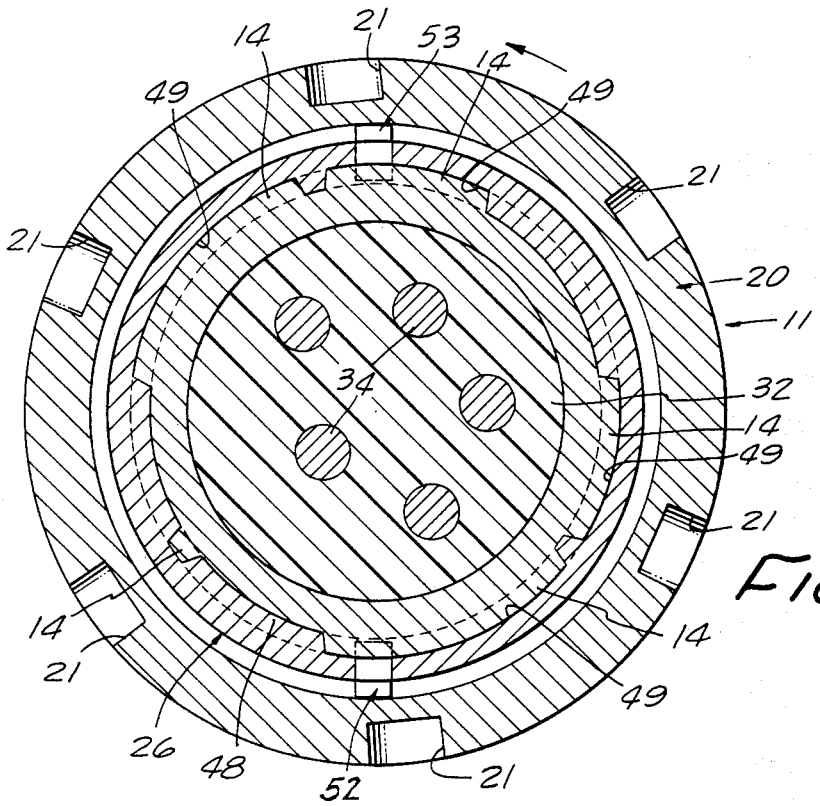
FIGS. 16 and 17 are views taken along the lines 16—16 and 17—17, respectively, of FIG. 14.
Figure 14:
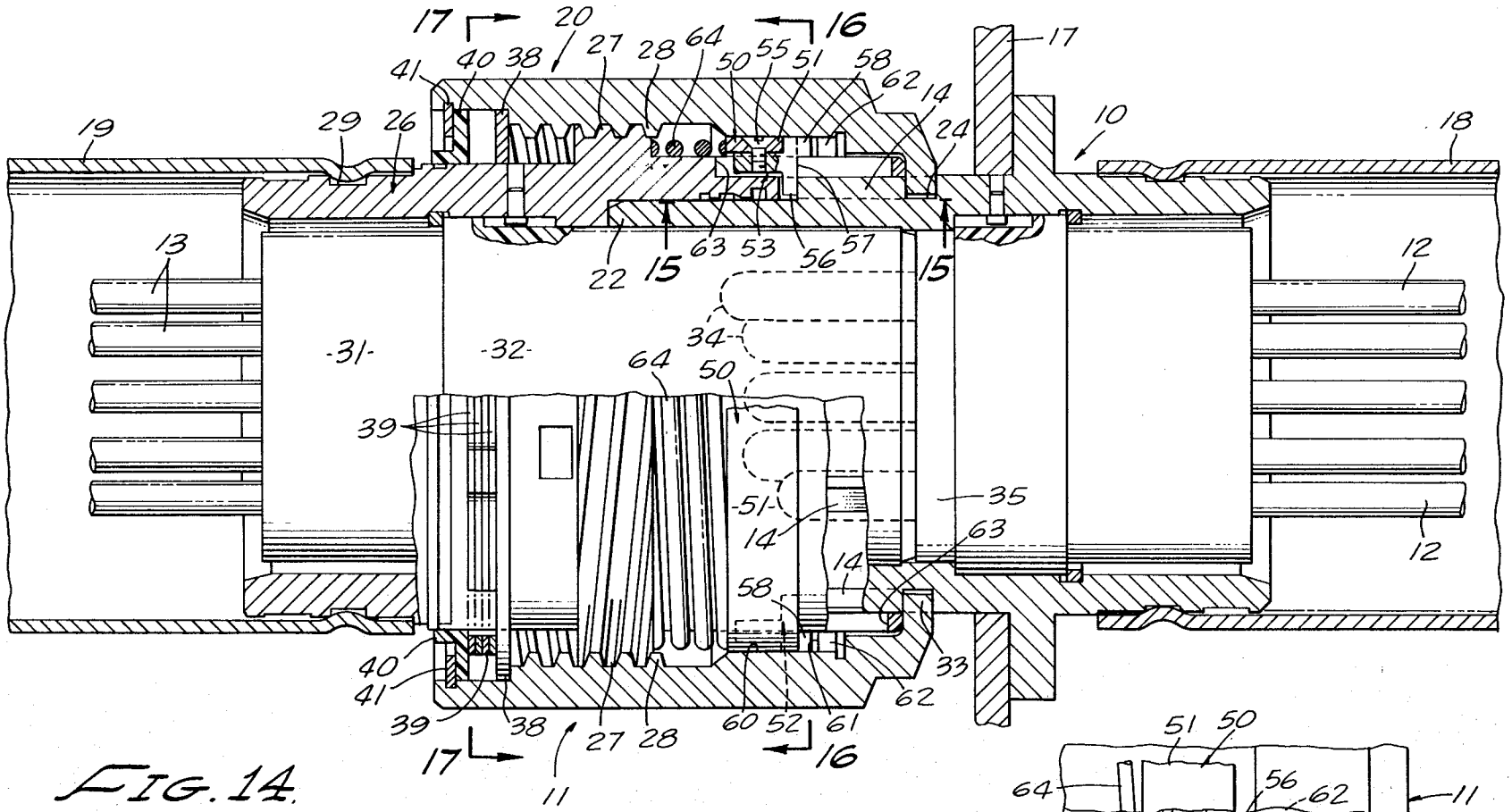
FIG. 14 is a view similar to FIG. 8 showing the connector parts fully coupled.
Figure 15:
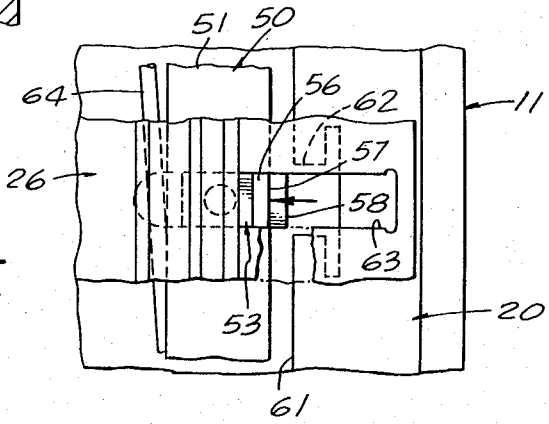
FIG. 15 is an enlarged sectional, partially fragmentary view taken along the line 15—15 of FIG. 14.
Figure 17:
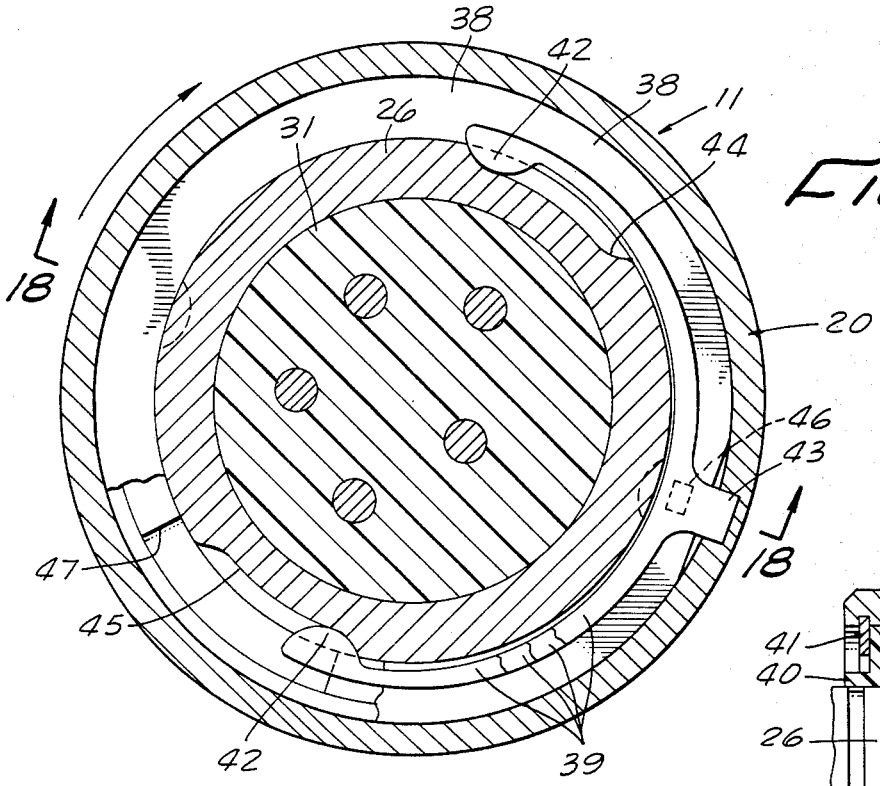
Figure 18:
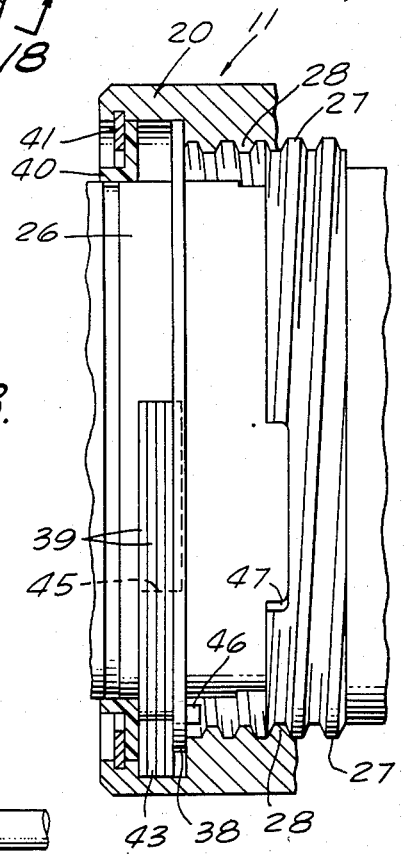
FIG. 18 is a view taken along line 18—18 of FIG. 17.

The washer 38 (FIG. 13) is more exactly defined as a stop washer in that on reaching the 0 degree positions with the detent springs snapped into the recessed areas, a projecting key 46 on the washer engages a stop notch 47 in the plug preventing any overriding rotation.

Figure 10:
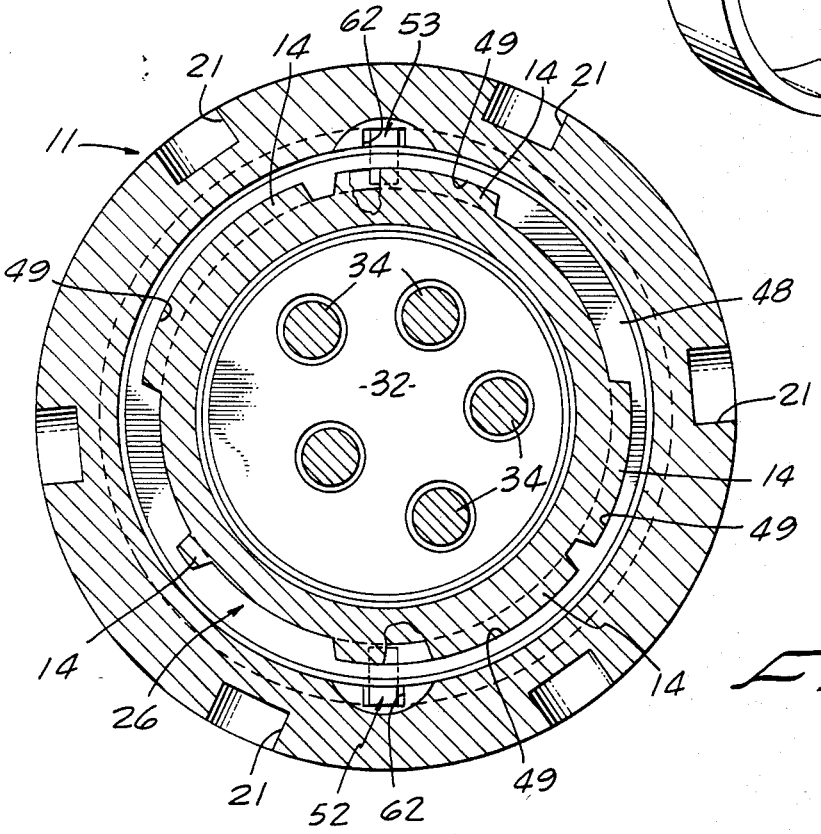
FIG. 10 is a sectional, end elevational view taken along the line 10—10 of FIG. 8.

As has already been alluded to, the plug shell 26 includes at its receptacle receiving end a set of keyways corresponding to the coupling ring keyways 25, and which are aligned therewith for initial receipt of the receptacle. More particularly, as shown in FIG. 10 the outermost end of the plug shell includes a radially inwardly directed flange 48 having portions removed forming the keyways 49 which can be aligned with the coupling ring keyways. In prior connectors of this general kind, such as the connector described in the referenced U.S. patent, the coupling housing could be inadvertently rotated with respect to the plug shell before the receptacle was in position misaligning the keyways and preventing mating of the connector parts. To correct the "timing" of these prior connectors requires manipulation of the coupling ring and plug shell as well as familiarity with the connector construction.

Figure 11:
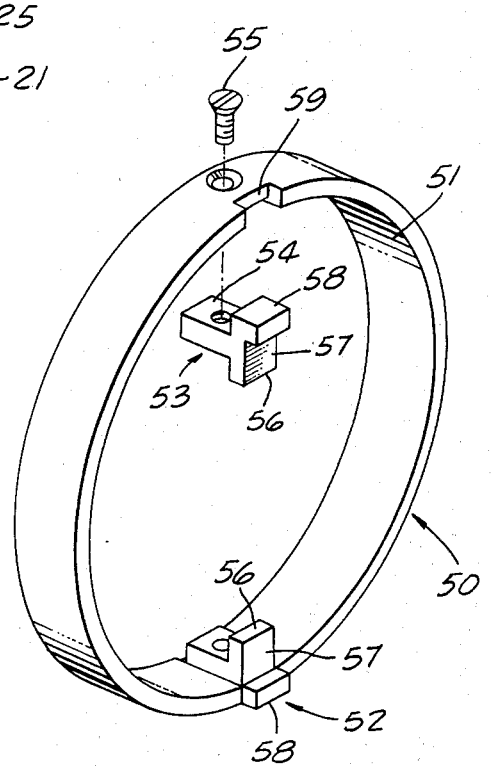
FIG. 11 is a perspective view of the interlock sleeve.

The present connector is prevented from having the coupling ring and plug shell become inadvertently misaligned before entry of the receptacle by utilization of an interlock sleeve 50 which effectively secures the coupling ring and plug shell in a fixed relation to each other until the receptacle keys are received at least partway within the ring and plug keyways. As shown in FIG. 11, the interlock sleeve includes an annular metal band 51 of uniform width with first and second identically shaped actuators 52, 53 fixedly secured to the band at 180 degree angular spacing. More particularly, each actuator has a flat mounting portion 54 which abuts against the inner surface of the annular band and via which the actuator is secured to the band by a threaded member 55. An integral driving member 56 extends away from mounting portion 54 radially inwardly of the annular band and has a flat driving surface 57 coplanar with one of the circular edges of the band 51 in assembly. A steplike locking projection 58 fits into a notch 59 formed in the annular band edge and extends outwardly of the edge.

In assembly and with reference simultaneously to FIGS. 8 and 20–22, the annular band 51 is located between the plug shell 26 and coupling ring 20, and adapted to slide axially along the inner wall 60 of the coupling ring for a prescribed amount in the general region of the coupling ring open end. Specifically as shown best in FIGS. 20 and 22, the coupling ring inner wall 60 includes a circumferential shoulder 61 against which the edge of the band 51 abuts thereby serving as an axial movement limit stop for the interlock sleeve. The locking projection 58 extends forwardly into a slot 62 formed in the shoulder 61 during abutment of the band 51 with the shoulder (FIG. 22).

The actuator member 56 passes through an axially extending opening 63 and projects inwardly of the plug shell to lie within a plug keyway 49. The slotlike opening 63 is so dimensioned as to enable the actuator member 56 to move freely therealong, while at the same time constrain the member and band 51 from relative movement circumferentially about the plug shell.

A coil spring 64 is received about the plug shell 26 with one end contacting the inner side wall of threads 27 and the other end contacting the inner edge of the annular member 51. The spring is a compression spring resiliently urging the interlock sleeve 50 away from the threaded portion of the plug shell toward the plug open end and into contact with the shoulder 61 on the coupling ring.

Figure 9:
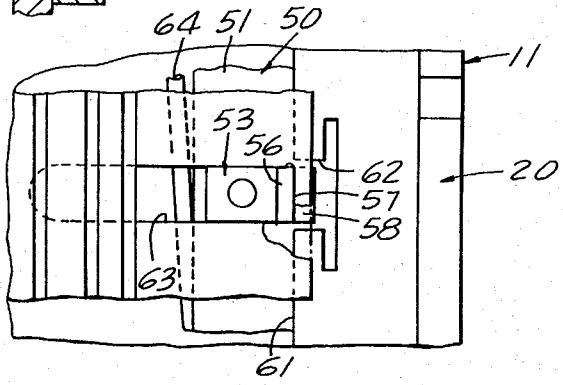
FIG. 9 is a sectional, elevational, partially fragmentary view taken along the line 9—9 of FIG. 8.

Both driving projections 56 are located within a plug shell keyway 49 so that as the receptacle keys move therethrough they engage the surfaces 57 of projections 56 and drive the interlock sleeve 50 inwardly toward the plug threads compressing spring 64 (FIGS. 9 and 21). This also moves the locking projections 58 out of their captivated state by the walls of slot 62 as shown in FIG. 22 so that rotation of the coupling ring with respect to the plug shell is now possible and completion of connector mating may be achieved.

On unmating, the interlock sleeve is returned to the situation shown in FIG. 22 so that the coupling ring and plug shell are in their timed relation and rotation of either with respect to the other is not possible.

Turning now to FIG. 19, a receptacle with a preferred arrangement of pin contacts is shown. More particularly, one pin contact 66 which is longer than the others is ground connected to the receptacle shell and, when the connector parts are mated, the pin will be received into a socket contact which is grounded. In this way the first electrical condition achieved on mating of the connector parts is the common grounding of both plug and receptacle.

Next, one or more pins 67 of lesser length than grounding pin 66 engage corresponding sockets to provide current paths between specified equipment. Finally, a pin 68, which is shorter than either of the pins 66 and 67, on mating with the appropriate socket picks up a relay which provides power to the lines interconnected with pins 67.

Accordingly, there is described herein an electrical connector offering special advantages for use in interconnecting relatively large-sized, rigid wire cables. Compensation for tolerances is achieved without recourse to spring-loaded devices making the connection more reliable in that it is substantially completely insensitive to separation resulting from axially applied forces. Complexity of manufacture is reduced and weight is kept to a minimum by having the coupling housing of one-piece construction.

The sole tolerance compensating means of the described electrical connector is compliant insulative layer 35 which on mating of the connector parts is compressed between the plug and receptacle rigid insulators to a degree depending upon the accumulated tolerances of the connector components. That is, the overall thickness of the layer 35 and cones 36 as measured along the pins is such that when the accumulated tolerances provide the maximum spacing between the insulators on mating, the layer is compressed sufficiently to seal off the contacts. Also, the layer thickness must not be so great as to prevent mating of the parts on minimum tolerance spacing, or to produce substantial buckling of the layer due to excessive pressure resulting in loss of seal.

Also especially advantageous, is the incorporation of an interlock sleeve between the coupling housing and plug for insuring keyway alignment integrity until the receptacle is sufficiently received within the plug. Tactile and audible means for indicating when mating and unmating occur (i.e., at 0 degrees) also are aided by a stop washer keyed to the coupling housing for preventing override beyond the 0 degrees positions.

We claim:

1. An electrical connector having plug and receptacle parts which are selectively joinable by rotation of a coupling ring, comprising:

the coupling ring has a threaded bore which directly and continuously engages a complementary set of threads on an outer surface of the plug, and a flange which lockingly engages the receptacle during joining the connector parts;

means carried by and rotating with the coupling ring which contact further means carried by the plug preventing relative rotation of the coupling ring and plug beyond predetermined maxima; and a layer of resilient insulative material carried by one of the connector parts which is compressed during joining of the connector parts, said layer having a predetermined thickness insuring layer compression throughout the full range of connector part manufacturing tolerances.

2. An electrical connector as in claim 1, in which said means rotating with the coupling ring includes a washer and projection therefrom, and the means carried by the plug includes a slot within which the washer projection is received.

3. An electrical connector as in claim 1, in which means is provided preventing rotation of the coupling ring relative to the plug when the plug is unmated with the receptacle, said rotation preventing means being engaged by parts carried by said receptacle for allowing rotation of the coupling housing with respect to the plug.

4. An electrical connector having plug and receptacle parts which are releasably mated by selective rotation of a coupling ring carried by said plug for interconnecting pin and socket contacts respectively mounted within said connector parts, comprising:

the coupling ring has a flange with at least one keyway formed therein aligned with a keyway formed in the plug when the plug is released from the receptacle, at which time spring-loaded means extend into the plug keyway obstructing rotation of the coupling ring with respect to the plug, and said spring-loaded means being movable from said coupling ring obstructing position to a further position allowing the coupling ring to rotate about the plug.

5. An electrical connector as in claim 4, in which a key on the receptacle engages the spring-loaded means on said receptacle mating with the plug moving said spring-loaded means to the further position.

6. An electrical connector as in claim 5, in which the spring-loaded means returns to the coupling ring rotation obstructing relation on the receptacle being removed from the plug.

7. An electrical connector as in claim 4, in which there are two keyways provided in the plug and coupling ring at substantially 180 degree angular spacing, said spring-loaded means including an annular interlock sleeve located between the coupling ring and plug with first and second actuators mounted thereon extending into the respective keyways, and a spring urging the interlock sleeve toward the plug open end, the receptacle including first and second keyways so dimensioned and located as to fit into the keyways on mating of the plug and receptacle and engage both the actuators releasing the coupling ring for rotation.

* * * * *